US009206381B2

(12) United States Patent
Hodge et al.

(10) Patent No.: US 9,206,381 B2
(45) Date of Patent: Dec. 8, 2015

(54) REDUCED MISTING ALKALINE CLEANERS USING ELONGATIONAL VISCOSITY MODIFIERS

(71) Applicant: ECOLAB USA INC., St. Paul, MN (US)

(72) Inventors: Charles Allen Hodge, Cottage Grove, MN (US); Nathan D. Peitersen, Apple Valley, MN (US); Amanda Ruth Blattner, Prior Lake, MN (US); Heinrich Bode, Aurora, IL (US); Jinfeng Wang, Aurora, IL (US); Claire Lucille Notermann, Eagan, MN (US); Mark Levitt, Lake Elmo, MN (US)

(73) Assignee: ECOLAB USA INC., St. Paul, MN (US)

( * ) Notice: Subject to any disclaimer, the term of this patent is extended or adjusted under 35 U.S.C. 154(b) by 196 days.

(21) Appl. No.: 13/926,439

(22) Filed: Jun. 25, 2013

(65) Prior Publication Data

US 2013/0284205 A1 Oct. 31, 2013

Related U.S. Application Data

(63) Continuation-in-part of application No. 13/622,649, filed on Sep. 19, 2012.

(60) Provisional application No. 61/537,390, filed on Sep. 21, 2011.

(51) Int. Cl.

| | |
|---|---|
| ***C11D 17/00*** | (2006.01) |
| ***C11D 3/37*** | (2006.01) |
| ***C11D 3/20*** | (2006.01) |
| ***C11D 1/04*** | (2006.01) |
| ***C11D 3/04*** | (2006.01) |

(52) U.S. Cl.

CPC ..... *C11D 3/3719* (2013.01); *C11D 1/04* (2013.01); *C11D 3/044* (2013.01); *C11D 3/2068* (2013.01);

(Continued)

(58) Field of Classification Search

CPC ..... C11D 17/0043; C11D 1/02

See application file for complete search history.

(56) References Cited

U.S. PATENT DOCUMENTS

| | | | |
|---|---|---|---|
| 3,658,988 | A | 4/1972 | Scher et al. |
| 4,140,516 | A | 2/1979 | Scher |

(Continued)

FOREIGN PATENT DOCUMENTS

| | | | |
|---|---|---|---|
| BG | 65638 | B1 | 4/2009 |
| CA | 1085238 | A | 9/1980 |

(Continued)

OTHER PUBLICATIONS

Bozetine, I., et al., "Optimization of an Alkylpolyglucoside-Based Dishwashing Detergent Formulation", J. Surfact. Deterg. (2008) 11, pp. 299-305.

(Continued)

*Primary Examiner* — Gregory Webb

(74) *Attorney, Agent, or Firm* — McKee, Voorhees & Sease, PLC

(57) ABSTRACT

Alkaline spray-on cleaners that can be delivered by pump or pressurized gas aerosol spray have been made with reduced choking mists are disclosed. The cleaning composition comprises the use of anti-mist components consisting of large anionic copolymer comprised of acrylamide and AMPS (acrylamide-sodium 2-acrylamido-2-methylpropane sulfonate), and polyethylene oxide polymers that create non-Newtonian solutions. The composition also includes a surfactant, and a source of alkalinity.

13 Claims, 4 Drawing Sheets

(52) U.S. Cl.
CPC ..... *C11D 3/2079* (2013.01); *C11D 3/3707* (2013.01); *C11D 3/378* (2013.01); *C11D 17/0026* (2013.01); *C11D 17/0043* (2013.01)

(56) References Cited

U.S. PATENT DOCUMENTS

| | | | | |
|---|---|---|---|---|
| 4,314,841 | A | 2/1982 | Scher | |
| 4,357,351 | A | 11/1982 | Fancher et al. | |
| 4,425,241 | A | 1/1984 | Swanson | |
| 4,440,563 | A | 4/1984 | Scher | |
| 4,500,494 | A | 2/1985 | Scher | |
| 4,510,081 | A | 4/1985 | Bronner et al. | |
| 4,515,813 | A | 5/1985 | Francher et al. | |
| 4,673,704 | A | 6/1987 | Flesher et al. | |
| 4,778,836 | A | 10/1988 | Farrar et al. | |
| 4,898,611 | A | 2/1990 | Gross | |
| 4,929,655 | A | 5/1990 | Takeda et al. | |
| 4,933,167 | A | 6/1990 | Scher et al. | |
| 4,956,129 | A | 9/1990 | Scher et al. | |
| 5,120,542 | A | 6/1992 | Scher et al. | |
| 5,134,961 | A | 8/1992 | Giles et al. | |
| 5,332,584 | A | 7/1994 | Scher et al. | |
| 5,364,551 | A | 11/1994 | Lentsch et al. | |
| 5,454,984 | A | 10/1995 | Graubart et al. | |
| 5,912,207 | A | 6/1999 | Scher et al. | |
| 5,977,050 | A * | 11/1999 | Faris | 510/403 |
| 6,485,736 | B1 | 11/2002 | Shirley et al. | |
| 6,541,422 | B2 | 4/2003 | Scher et al. | |
| 6,544,540 | B2 | 4/2003 | Van Koppenhagen et al. | |
| 6,652,766 | B1 * | 11/2003 | Frankenbach et al. | 252/8.91 |
| 6,653,274 | B1 * | 11/2003 | Godfroid et al. | 510/499 |
| 6,750,190 | B2 | 6/2004 | Colurciello et al. | |
| 7,271,200 | B2 | 9/2007 | Scher et al. | |
| 7,278,294 | B2 | 10/2007 | Giles et al. | |
| 7,311,004 | B2 | 12/2007 | Giles | |
| 7,502,665 | B2 | 3/2009 | Giles et al. | |
| 7,566,448 | B2 * | 7/2009 | Becker et al. | 424/94.63 |
| 7,665,348 | B2 | 2/2010 | Giles | |
| 7,742,842 | B2 | 6/2010 | Giles et al. | |
| 7,826,930 | B2 | 11/2010 | Giles et al. | |
| 8,109,448 | B2 | 2/2012 | Giles | |
| 8,173,159 | B2 | 5/2012 | Scher et al. | |
| 8,250,907 | B2 | 8/2012 | Giles | |
| 2002/0037306 | A1 | 3/2002 | Van Koppenhagen et al. | |
| 2004/0224867 | A1 | 11/2004 | Colurciello et al. | |
| 2006/0089443 | A1 | 4/2006 | Roa-Espinosa | |
| 2007/0043119 | A1 | 2/2007 | Graeber et al. | |
| 2007/0264344 | A1 | 11/2007 | Segura-Orsoni et al. | |
| 2008/0230624 | A1 | 9/2008 | Giles et al. | |
| 2010/0286019 | A1 | 11/2010 | Scher et al. | |
| 2012/0168532 | A1 | 7/2012 | Giles | |

FOREIGN PATENT DOCUMENTS

| | | | |
|---|---|---|---|
| CA | 1199808 | A | 1/1986 |
| CA | 2101641 | C | 8/1992 |
| CA | 1317875 | C | 5/1993 |
| CA | 2122956 | A1 | 11/1994 |
| CA | 2245537 | C | 8/1997 |
| CA | 2276364 | C | 7/1998 |
| CA | 2339013 | A1 | 2/2000 |
| CA | 2376679 | C | 3/2001 |
| CA | 2405977 | C | 12/2001 |
| CA | 2447759 | A1 | 12/2002 |
| CA | 2447759 | C | 12/2002 |
| CA | 2493361 | A1 | 2/2004 |
| CA | 2512324 | A1 | 1/2007 |
| EP | 0005302 | A3 | 11/1979 |
| EP | 0085327 | B1 | 1/1983 |
| EP | 0411218 | A1 | 2/1991 |
| EP | 0523198 | B1 | 1/1993 |
| EP | 0623052 | B1 | 11/1994 |
| EP | 0787778 | A1 | 8/1997 |
| EP | 1103017 | B1 | 5/2001 |
| GB | 2306965 | | 5/1997 |
| GB | 2353287 | A | 2/2001 |
| JP | 09-296121 | | 11/1997 |
| WO | WO 80/02024 | A1 | 10/1980 |
| WO | WO 92/10093 | A1 | 6/1992 |
| WO | WO 92/13448 | A1 | 8/1992 |
| WO | WO 93/14865 | A1 | 8/1993 |
| WO | 9419443 | A1 | 9/1994 |
| WO | WO 97/07675 | A1 | 3/1997 |
| WO | WO 97/27748 | A1 | 8/1997 |
| WO | WO 97/39089 | A1 | 10/1997 |
| WO | WO 98/28975 | A1 | 7/1998 |
| WO | WO 00/05951 | A1 | 2/2000 |
| WO | WO 00/05952 | A1 | 2/2000 |
| WO | WO 01/19509 | A1 | 3/2001 |
| WO | WO 02/48299 | A1 | 6/2002 |
| WO | WO 02/100525 | A3 | 12/2002 |
| WO | WO 2004/010930 | A2 | 2/2004 |
| WO | WO 2004/010930 | A3 | 2/2004 |
| WO | WO 2007/104895 | A1 | 9/2007 |
| WO | WO 2009/143513 | A1 | 11/2009 |
| WO | 2011036053 | | 3/2011 |
| WO | WO 2013/043699 | A2 | 3/2013 |
| WO | WO 2013/043699 | A3 | 3/2013 |
| WO | WO 2013/064315 | A1 | 5/2013 |

OTHER PUBLICATIONS

Bruschweiler, Dr. H., et al., "Flüssigwaschmittel", Tenside Detergents 23 (1986) 1, pp. 7-12.

Dexter, R.W., "Measurement of Extensional Viscosity of Polymer Solutions and Its Effects on Atomization From a Spray Nozzle", Atomization and Sprays, vol. 6, 1996, pp. 167-191.

Filipović-Vinceković, Dr. N., et al., "Surfactants in Liquid Decontamination Processes", Tenside Surfactants Detergents, 24 (1987) 3, pp. 167-172.

Giles, D. Ken, "Independent Control of Liquid Flow Rate and Spray Droplet Size From Hydraulic Atomizers", Atomization and Sprays, vol. 7, 1997, pp. 161-181.

Giles, D.K., et al., "Suppression of Aerosol Generation During Spraying and Deposition of Consumer Products", Atomization and Sprays, vol. 15, 2005, pp. 423-438.

Jadidi, Nazanin, et al., "Synergism and Performance Optimization in Liquid Detergents Containing Binary Mixtures of Anionic-Nonionic, and Anionic-Cationic Surfactants", J. Surfact. Deterg. (2013) 16: pp. 115-121.

Malihi, F.B., et al., "Evaluation of Physico-Chemical Interactions between Linear Alkylbenzene Sulfonate (LAS) and Alcohol Ethoxylates", Tenside Surf. Det. 48 (2011) 5, pp. 395-399.

Raney, Kirk H., "Optimization of Nonionic/Anionic Surfactant Blends for Enhanced Oily Soil Removal", JAOCS. vol. 68, No. 7 (Jul. 1991), pp. 525-531.

Rojvoranun, Sureeporn, et al., "Mechanistic Studies of Particulate Soil Detergency: I. Hydrophobic Soil Removal", J. Surfact Deterg. (2012) 15: pp. 277-289.

Rojvoranun, Sureeporn, et al., "Mechanistic Studies of Particulate Soil Detergency: II. Hydrophilic Soil Removal", J. Surfact Deterg. (2012) 15: pp. 663-677.

Zoid, T. Ahmed, et al., "Response Surface Methodology as an Approach to the Optimization of a Dishwashing Detergent", Tenside Surf. Det. 44 (2007) 2, pp. 94-101.

The International Bureau of WIPO, "International Preliminary Report on Patentability", issued in connection to International Application No. PCT/US2012/056078, 9 pages, mailed Mar. 25, 2014.

European Patent Office, "Partial European Search Report" issued in connection to International Application No. EP 14 16 8793, 7 pages, mailed Sep. 4, 2014.

European Patent Office, "Partial European Search Report" issued in connection to International Application No. EP 14 16 8790, 8 pages, mailed Nov. 6, 2014.

European Patent Office, "Extended European Search Report," issued in connection with European Patent Application No. 12834393.6, mailed on Jul. 21, 2015, 10 pp.

* cited by examiner

REDUCED MISTING ALKALINE CLEANERS USING ELONGATIONAL VISCOSITY MODIFIERS

CROSS-REFERENCE TO RELATED APPLICATION

This application is a Continuation-in-part of application U.S. Ser. No. 13/622,649 filed Sep. 19, 2012, which claims priority to U.S. Ser. No. 61/537,390 filed Sep. 21, 2011, all of which are herein incorporated by reference in their entirety.

TECHNICAL FIELD

The invention relates to aqueous alkaline cleaners that can be used to remove stubborn soils from food preparation units, counters, tables, floors and walls. In particular, the invention relates to aqueous alkaline materials that can be applied, in the form of an aerosol or pump spray, onto stubborn soils present in food preparation units with reduced misting.

BACKGROUND OF THE INVENTION

Aqueous sprayable compositions can be applied to a hard surface with a transient trigger spray device or an aerosol spray device. These cleaners have great utility because they can be applied by spray to vertical, overhead or inclined surfaces. Spray devices create a spray pattern of the aqueous sprayable compositions that contacts the target hard surfaces. The majority of the sprayable composition comes to reside on the target hard surfaces as large sprayed-on deposits, while a small portion of the sprayable composition may become an airborne aerosol or mist, which consists of small particles comprising the cleaning composition that can remain suspended or dispersed in the atmosphere surrounding the dispersal site for a period of time, such as between about 5 seconds to about 10 minutes. One substantial problem that arises with such spray-on materials relates to an airborne mist or finely divided aerosol generated during the spraying process. The aqueous liquid is converted by the action of propellant or pump action into a spray that is accompanied by a finely divided aerosol or mist. The spray portion contacts and remains on the target surface, while a substantial proportion of the aerosol can remain suspended in the atmosphere.

Such aqueous compositions having a strong base cleaning component in the form of a finely divided aerosol or mist can cause respiratory distress in the user. Upon breathing the finely divided aerosol or mist, a very strong and irrepressible choking response is seen in most individuals that come in contact with irritating proportions of the aerosol produced by typical spray-on cleaners. The choking response is inconvenient, reduces cleaning efficiency in a variety of applications and in sensitive individuals can cause asthma attacks, respiratory damage, or other discomfort or injury.

To alleviate the choking response, some products have been formulated with reduced quantities of the alkaline cleaning components. Strong caustic has been replaced by reduced alkalinity bases such as bicarbonate or by solvent materials. The reduction in concentration or substitution of these materials can often reduce the cleaning activity and effectiveness of the material when used.

Crotty et al., U.S. Pat. No. 3,644,210, teach an alkaline cleaning material useful for removing burnt-on, baked-on food and grease from cooking surfaces comprising substantial proportions of alkali metal hydroxide in an aqueous cleaning base. Eisen, U.S. Pat. No. 3,779,933 teaches an aqueous alkali metal cleaning composition using clay and organic thickening materials. Mukai et al., U.S. Pat. No. 3,813,343, teach oven cleaning compositions containing an amine or ammonia base combined with dimethyl sulfoxide solvent and other compositions. Wise et al., U.S. Pat. No. 3,829,387, teach caustic cleaning compositions containing substantial proportions of sodium hydroxide, clay thickeners, and solvents in an aqueous base. Dillarstone et al., U.S. Pat. No. 4,214,915, and Canadian Patent No. 1,523,491, teach oven cleaning compositions using a relatively mild base such as sodium carbonate and sodium bicarbonate in an aqueous cleaning material. Culshaw, U.S. Pat. No. 4,676,920 teaches a thickened viscous scouring material using surfactants, abrasives and solvents for soil removal. De Buzzaccarini, U.S. Pat. No. 4,767,563, teach liquid scouring cleaning compositions using solvents, abrasives and surfactants for soil removal from hard surfaces. Cockrell, Jr., U.S. Pat. No. 4,877,691 (International Application No. PCT/US91/05092) teaches a barrier coating composition used to pretreat an oven to promote the subsequent removal of hardened baked-on soils that form on the pretreatment material. Dimond et al., Canadian Patent No. 1,047,903, teach oven cleaning compositions having reduced proportions of sodium hydroxide which are thickened using a bentonite in a substantially aqueous base. Silvester, Canadian Patent No. 1,211,674, teaches an improved oven cleaner using sodium bicarbonate as an alkali, glycerol as a solvent, a clay thickener in an aqueous formulation for oven cleaning Flannery, United Kingdom Patent No. 2,019,876, teaches an aerosol comprising sodium bicarbonate as an oven cleaner. Lentsch et al, U.S. Pat. No. 5,364,551 uses xanthan gum as an anti-mist agent in a thickening, Newtonian methodology to increase particle size.

The prior art taken as a whole shows that skilled artisans in experimenting with improving alkaline hard surface cleaners, in particular alkaline oven cleaners, have attempted to reduce concentrations of sodium hydroxide to reduce the choking response. Ammonia or an organic base has been used to replace sodium hydroxide in reduced alkaline cleaners. Other relatively mild inorganic basic materials, such as sodium carbonate or sodium bicarbonate have also been used to replace sodium hydroxide. A variety of organic surfactants or glycol, alkyl ether or dimethyl sulfoxide solvent materials have been used to enhance the detergent properties of the reduced alkaline materials.

SUMMARY OF THE INVENTION

The invention makes use of a non-Newtonian composition that reduces aerosol mist and includes at least one source of alkalinity, at least one surfactant and an anti-mist component. The anti-mist component is selected from polyethylene oxide, and/or anionic copolymer comprised of acrylamide and AMPS (acrylamide-sodium 2-acrylamido-2-methylpropane sulfonate) and combinations thereof. The non-Newtonian composition has a viscosity of less than about 40 centipoise.

In another embodiment, the non-Newtonian composition includes water, at least one source of alkalinity, at least one surfactant and an anti-mist component. A further embodiment is a method of using a cleaning solution. The anti-mist component is present in an amount of between about 0.001 wt. % to about 0.4 wt. % where the anti-mist component is selected from polyethylene oxide, anionic copolymer comprised of acrylamide and AMPS (acrylamide-sodium 2-acrylamido-2-methylpropane sulfonate) and combinations thereof.

The cleaners of the invention can be packaged in pressurized aerosol spray units using commonly available pressure containers, aerosol valves and aerosol propellants. The cleaners of the invention can be used in a pump spray format using a pump spray head and a suitable container. The materials are typically applied to hard surfaces containing difficult inorganic, organic, or matrix-blended soils. Such soils include baked-on or carbonized food residues. Other surfaces can contain soils derived from substantially insoluble hardness components of service water. The enhanced cleaning compositions of the invention rapidly remove such soils because the cleaners have a unique combination of cleaning ingredients combined with thickeners that can rapidly remove the soils but resist formation of an amount of mist or aerosol during application that can cause respiratory distress.

For the purpose of this application, the terms "aerosol" and "mist" refer to airborne dispersions of small particles comprising the cleaning composition that can remain suspended or dispersed in the atmosphere surrounding a cleaning site for at least 5 seconds, more commonly 15 seconds to 10 minutes.

The invention relates to aqueous alkaline cleaners that can be used to remove stubborn soils from food preparation units, and aqueous alkaline cleaners that are used to remove soils from hard surfaces such as counters, tables, floors and walls. In particular, the invention relates to aqueous alkaline materials that can be applied, in the form of an aerosol or pump spray, onto stubborn grease soils present in food preparation units such as gas or electrically heated ovens, microwave ovens, toaster ovens, etc. The term oven includes ovens, deep fryers, grills and hoods.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE INVENTION

Figure 1:
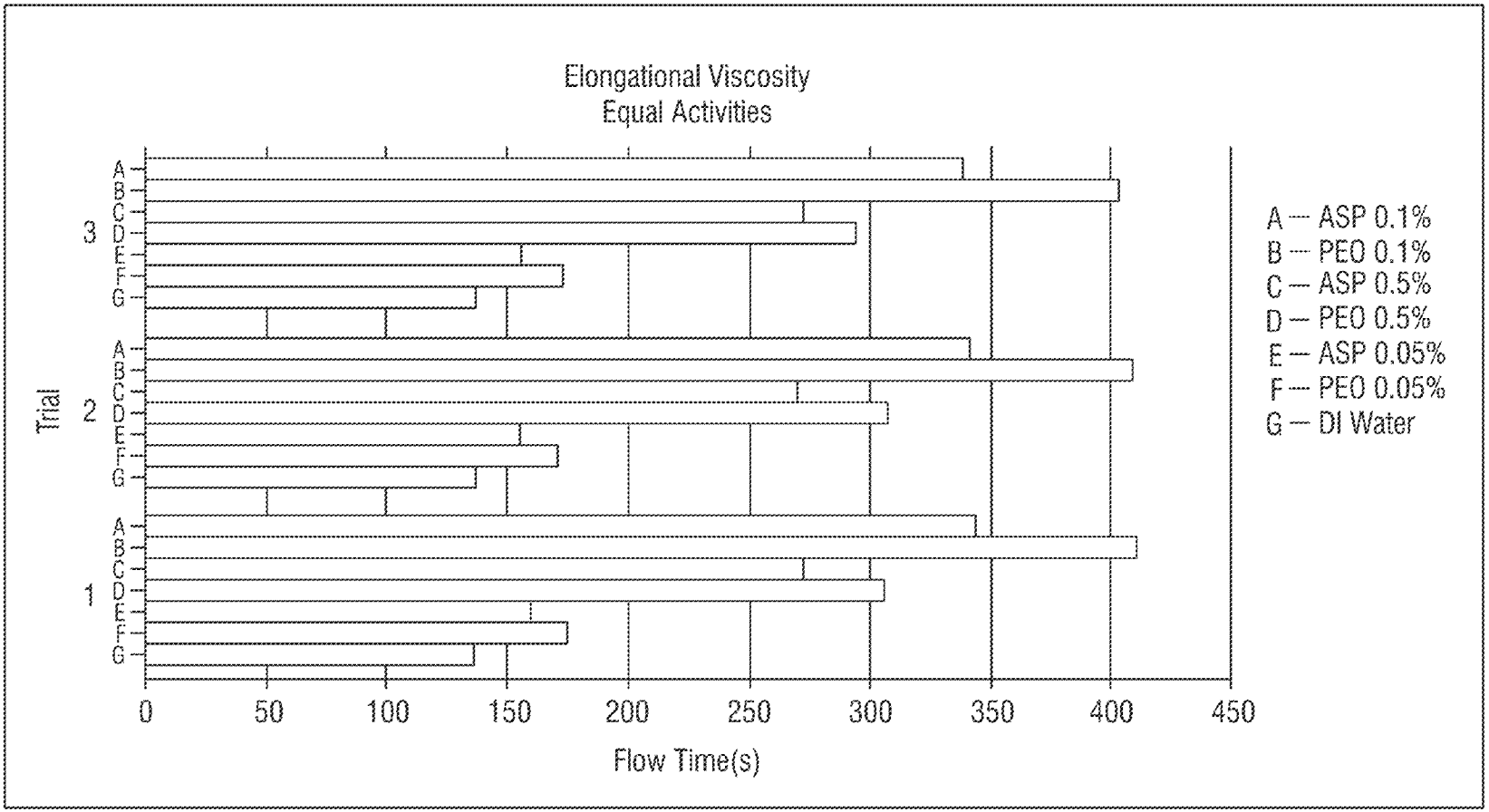
FIG. 1 is a graph showing flow time and elongational viscosity for ASP FFR-900, PolyOx WSR-301 and deionized water at equal actives.

The present invention relates to ready-to-use (RTU) sprayable compositions including an anti-mist component, such as polyethylene oxide, anionic copolymer comprised of acrylamide and AMPS (acrylamide-sodium 2-acrylamido-2-methylpropane sulfonate) and combinations thereof. In one embodiment, the sprayable compositions may contain a sufficient amount of anti-mist component such that when the solution is dispensed from a transient trigger sprayer, the solution exhibits an increased median droplet size and reduced mist or aerosol. In one embodiment, the sprayable use solution produces little or no small particle aerosol. The sprayable compositions can be used in any environment where it is desirable to have larger droplet sizes dispensed from a transient trigger sprayer. For example, the sprayable composition can be used in institutional applications, food and beverage applications, heath care applications, vehicle care applications, pest elimination applications, and laundering applications. Such applications include but are not limited to laundry and textile cleaning and destaining, kitchen and bathroom cleaning and destaining, carpet cleaning and destaining, vehicle cleaning and destaining, cleaning in place operations, general purpose cleaning and destaining, surface cleaning and destaining, particularly hard surfaces, glass window cleaning, air freshening or fragrancing, industrial or household cleaners, antimicrobial cleaning Methods of using the sprayable compositions are also provided.

Anti-Mist Component

The sprayable composition includes at least one anti-mist component, such as polyethylene oxide (PEO), anionic copolymer comprised of acrylamide and AMPS (acrylamide-sodium 2-acrylamido-2-methylpropane sulfonate) or combinations thereof. The anti-mist component may function to reduce atomization and misting of the sprayable solution when dispensed using a sprayer, including aerosol sprayers and transient trigger sprayers. Example transient trigger sprayers include stock transient trigger sprayers (i.e., non-low velocity trigger sprayer) and low-velocity trigger sprayers, both available from Calmar. Suitable commercially available stock transient trigger sprayers include Calmar Mixor HP 1.66 output trigger sprayer. The anti-mist component may also increase the median particle size of the dispensed use solution, which reduces inhalation of the use solution, and particularly reduces inhalation of the sensitizer or irritant.

In one example, the RTU sprayable composition includes polyethylene oxide (PEO) or anionic copolymer comprised of acrylamide and AMPS (acrylamide-sodium 2-acrylamido-2-methylpropane sulfonate). In another example, the RTU sprayable composition includes mixtures of polyethylene oxide (PEO) and anionic copolymer comprised of acrylamide and AMPS (acrylamide-sodium 2-acrylamido-2-methylpropane sulfonate). PEO is a high molecular weight polymer. A suitable PEO can have a molecular weight between about 3,000,000 and about 7,000,000. One commercially available PEO is PolyOx WSR-301, which has a molecular weight of about 4,000,000 and is available from Dow. A suitable concentration range for PEO is between approximately 0.001% and 0.8% by weight of the sprayable solution. A particularly suitable concentration range for PEO is between approximately 0.005% and 0.5% by weight of the sprayable solution.

Another commercially available anionic copolymer comprised of acrylamide and AMPS (acrylamide-sodium 2-acrylamido-2-methylpropane sulfonate) is ASP FFR-900 available from NALCO, Naperville, Ill. A suitable concentration range for anionic copolymer comprised of acrylamide and AMPS (acrylamide-sodium 2-acrylamido-2-methylpropane sulfonate) is between approximately 0.001% and 0.4% by weight of the RTU sprayable solution. A particularly suitable concentration range for anionic copolymer comprised of acrylamide and AMPS (acrylamide-sodium 2-acrylamido-2-methylpropane sulfonate) is between approximately 0.02% and 0.2% by weight of the RTU sprayable solution.

The anti-mist component helps to create a non-Newtonian composition, in that shear provides a stretching component which in combination with larger particle size reduces misting. The compositions of the invention require the presence of a material that will provide a composition that permits the application of the material through a spray head. When sprayed from an aerosol container using a propellant, the material undergoes shear as it is drawn up a feed tube into an aerosol spray head under the influence of the pressure of a propellant or is sheared by the action of a pump in a pump action sprayer. In either case, the viscosity must drop to a point such that substantial quantities of the material can be applied using the spray devices used to apply the material to a soiled surface. However, once the material comes to rest on a soiled surface, the materials should regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, preferably five minutes or more and also reduce misting.

Source of Alkalinity

The liquid aqueous cleaner compositions of the invention can contain a base material or a source of alkalinity which can be an organic source or an inorganic source of alkalinity. For the purposes of this invention, a source of alkalinity also known as a basic material is a composition that can be added to an aqueous system and result in a pH greater than about 7. Organic sources of alkalinity are often strong nitrogen bases including, for example, ammonia, monoethanol amine, monopropanol amine, diethanol amine, dipropanol amine, triethanol amine, tripropanol amine, etc. One value of using the monoalkanol amine compounds relates to the solvent nature of the liquid amines. The use of some substantial proportion of a monoethanol amine, monopropanol amine, etc. can provide substantial alkalinity but can also provide substantial solvent power in combination with the other materials in the invention. The source of alkalinity can also comprise an inorganic alkali. The inorganic alkali content of the spray-on cleaners of the invention is preferably derived from sodium or potassium hydroxide which can be used in both liquid (about 10-60 wt. % aqueous solution) or in solid (powder, flake or pellet) form. Preferably the preferred form of the alkali metal base is commercially available sodium hydroxide which can be obtained in aqueous solution at concentrations of about 50 wt. % and in a variety of solid forms of varying particle size and shapes. Other inorganic alkalinity sources are soluble silicate compositions such as sodium metasilicate or soluble phosphate compositions such as trisodium phosphate. The source of alkalinity is present in an amount sufficient to achieve the desired pH of greater than 7, typically this is an amount of from about 0.1 wt. % to about 35 wt. %, preferably from about 0.5 wt. % to about 30 wt. % and more preferably from about 0.8 wt. % to about 28 wt. %.

Surfactant

The aqueous cleaning sprayable composition includes a surfactant. A variety of surfactants may be used, including anionic, nonionic, cationic, and amphoteric surfactants. Example suitable anionic materials are surfactants containing a large lipophilic moiety and a strong anionic group. Such anionic surfactants contain typically anionic groups selected from the group consisting of sulfonic, sulfuric or phosphoric, phosphonic or carboxylic acid groups which when neutralized will yield sulfonate, sulfate, phosphonate, or carboxylate with a cation thereof preferably being selected from the group consisting of an alkali metal, ammonium, alkanol amine such as sodium, ammonium or triethanol amine. Examples of operative anionic sulfonate or sulfate surfactants include alkylbenzene sulfonates, sodium xylene sulfonates, sodium dodecylbenzene sulfonates, sodium linear tridecylbenzene sulfonates, potassium octyldecylbenzene sulfonates, sodium lauryl sulfate, sodium palmityl sulfate, sodium cocoalkyl sulfate, sodium olefin sulfonate.

Nonionic surfactants carry no discrete charge when dissolved in aqueous media. Hydrophilicity of the nonionic is provided by hydrogen bonding with water molecules. Such nonionic surfactants typically comprise molecules containing large segments of a polyoxyethylene group in conjunction with a hydrophobic moiety or a compound comprising a polyoxypropylene and polyoxyethylene segment. Polyoxyethylene surfactants are commonly manufactured through base catalyzed ethoxylation of aliphatic alcohols, alkyl phenols and fatty acids. Polyoxyethylene block copolymers typically comprise molecules having large segments of ethylene oxide coupled with large segments of propylene oxide. These nonionic surfactants are well known for use in this art area. Additional example nonionic surfactants include alkyl polyglycosides.

The lipophilic moieties and cationic groups comprising amino or quaternary nitrogen groups can also provide surfactant properties to molecules. As the name implies to cationic surfactants, the hydrophilic moiety of the nitrogen bears a positive charge when dissolved in aqueous media. The soluble surfactant molecule can have its solubility or other surfactant properties enhanced using low molecular weight alkyl groups or hydroxy alkyl groups.

The cleaning composition can contain a cationic surfactant component that includes a detersive amount of cationic surfactant or a mixture of cationic surfactants. The cationic surfactant can be used to provide sanitizing properties. In one example, cationic surfactants can be used in basic compositions.

Cationic surfactants that can be used in the cleaning composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium compounds and salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, a naphthylene-substituted quaternary ammonium chloride such as dimethyl-1-naphthylmethylammonium chloride.

Amphoteric surfactants can also be used. Amphoteric surfactants contain both an acidic and a basic hydrophilic moiety in the structure. These ionic functions may be any of the anionic or cationic groups that have just been described previously in the sections relating to anionic or cationic surfactants. Briefly, anionic groups include carboxylate, sulfate, sulfonate, phosphonate, etc. while the cationic groups typically comprise compounds having amine nitrogens. Many amphoteric surfactants also contain ether oxides or hydroxyl groups that strengthen their hydrophilic tendency. Preferred amphoteric surfactants of this invention comprise surfactants that have a cationic amino group combined with an anionic carboxylate or sulfonate group. Examples of useful amphoteric surfactants include the sulfobetaines, N-coco-3,3-aminopropionic acid and its sodium salt, n-tallow-3-amino-dipropionate disodium salt, 1,1-bis(carboxymethyl)-2-undecyl-2-imidazolinium hydroxide disodium salt, cocoaminobutyric acid, cocoaminopropionic acid, cocoamidocarboxy glycinate, cocobetaine. Suitable amphoteric surfactants include cocoamidopropylbetaine and cocoaminoethylbetaine.

Amine oxides, such as tertiary amine oxides, may also be used as surfactants. Tertiary amine oxide surfactants typically comprise three alkyl groups attached to an amine oxide (N→O). Commonly the alkyl groups comprise two lower ($C_{1-4}$) alkyl groups combined with one higher $C_{6-24}$ alkyl groups, or can comprise two higher alkyl groups combined with one lower alkyl group. Further, the lower alkyl groups can comprise alkyl groups substituted with hydrophilic moiety such as hydroxyl, amine groups, carboxylic groups, etc. Suitable amine oxide materials include dimethylcetylamine oxide, dimethyllaurylamine oxide, dimethylmyristylamine oxide, dimethylstearylamine oxide, dimethylcocoamine oxide, dimethyldecylamine oxide, and mixtures thereof. The classification of amine oxide materials may depend on the pH of the solution. On the acid side, amine oxide materials protonate and can simulate cationic surfactant characteristics. At neutral pH, amine oxide materials are non-ionic surfactants and on the alkaline side, they exhibit anionic characteristics.

Another important class of surfactants include functionalized alkyl polyglucosides which can fall into any class of surfactants depending on the functional groups (nonionic, anionic, amphoteric etc.). One example includes the "green" series of surfactants based on the renewable resource of alkyl polyglucosides, available from Colonial Chemical. These include alkyl polyglucoside derivatives with various functional groups such as sulfonated and polysulfonated alkyl polyglucoside derivatives, phosphate and polyphosphate alkyl polyglucoside derivatives, quaternary functionalized alkyl polyglucoside derivatives, polyquaternary functionalized alkyl polyglucoside derivatives, betaine functionalized alkyl polyglucoside derivatives, sulfosuccinate functionalized alkyl polyglucoside derivatives, and the like.

The surfactant is present in the composition in an amount of from about 1 wt. % to about 20 wt. %.

Water

The alkaline sprayable compositions may include water. Suitable concentrations of water include between about 25% and 98% by weight.

Thickeners or Viscosity Modifiers

The invention involves the use of elongational viscosity modifiers that provide non-Newtonian solutions that also can provide anti-misting instead of traditional viscosity modifiers, but in some embodiments, a traditional thickener or viscosity modifier may be added in combination with the anti-mist or elongational viscosity modifiers disclosed herein.

A variety of well-known organic thickener materials are known in the art. Preferred thickeners for use in this invention are natural polymers or gums derived from plant or animal sources. Such materials are often large polysaccharide molecules having substantial thickening capacity.

A substantially soluble organic thickener is used to provide thixotropy to the compositions of the invention. The preferred thickeners have some substantial proportion of water solubility to promote easy removability. Examples of soluble organic thickeners for the aqueous compositions of the invention comprise carboxylated vinyl polymers such as polyacrylic acids and sodium salts thereof, boric acid, diethanolamide, coco-diethanolamide, coco-monoethanolamide, stearic-diethanolamide, ethoxylated cellulose, hydroxyethyl styrylamide, oleic-diethanolamide, stearic-monoethanolamide, cetyl alcohol, steroyl alcohol, polyacrylamide thickeners, ethanol glycol disterate, xanthan compositions, sodium alginate and algin products, hydroxypropyl cellulose, hydroxyethyl cellulose, and other similar aqueous thickeners that have some substantial proportion of water solubility. Preferred thickeners for use in the alkaline composition of the invention are xanthan thickeners sold by the Kelco Division of Merck under the tradenames KELTROL, KELZAN AR, KELZAN D35, KELZAN S, KELZAN XZ, and others. Such xanthan polymers are preferred due to their high water solubility, and great thickening power. Most preferably fully hydrolyzed (greater than 98.5 mol % acetate replaced with the —OH function). Preferred thickeners for inorganic alkaline cleaners include xanthan gum derivatives. Xanthan is an extracellular polysaccharide of *xanthomonas campestras*. Xanthan is made by fermentation based on corn sugar or other corn sweetener by-products. Xanthan comprises a poly beta-(1→4)-D-Glucopyranosyl backbone chain, similar to that found in cellulose. Aqueous dispersions of xanthan gum and its derivatives exhibit novel and remarkable rheological properties. Low concentrations of the gum have relatively high viscosity which permits it economical use and application. Xanthan gum solutions exhibit high pseudoplasticity, i.e. over a wide range of concentrations, rapid shear thinning occurs that is generally understood to be instantaneously reversible. Non-sheared materials have viscosity that appears to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which patent is incorporated by reference herein. Suitable crosslinking agents for xanthan materials include metal cations such as $Al^{+3}$, $Fe^{+3}$, $Sb^{+3}$, $Zr^{+4}$ and other transition metals, etc. Known organic crosslinking agents can also be used. The preferred crosslinked xanthan agent of the invention is KELZAN AR, a product of Kelco, a division of Merck Incorporated. KELZAN AR is a crosslinked xanthan that provides a thixotropic cleaner that can produce large particle size mist or aerosol when sprayed. When present, the thickener is typically in the composition in an amount of from about 0.005 wt. % to about 1.0 wt. %, or about 0.01 wt. % to about 0.5 wt. %.

Aqueous Solvents

The cleaner materials of the invention can optionally contain a compatible solvent. Suitable solvents are soluble in the aqueous cleaning composition of the invention at use proportions. The cleaner materials of the invention also typically include a volatile organic compound (VOC) such as but not limited to solvents. A compound is non-volatile if its vapor pressure is below 0.1 mm Hg at 20° C. VOCs have been the subject of regulation by different government entities, the most prominent regulations having been established by the California Air Resource Board in its General Consumer Products Regulation. Thus, it may be desirable to formulate the cleaner of the invention containing low or no VOCs. Preferred soluble solvents include lower alkanols, lower alkyl ethers, and lower alkyl glycol ethers. These materials are colorless liquids with mild pleasant odors, are excellent solvents and coupling agents and are typically miscible with aqueous cleaning compositions of the invention. Examples of such useful solvents include methanol, ethanol, propanol, isopropanol and butanol, isobutanol, benzyl alcohol, ethylene glycol, diethylene glycol, triethylene glycol, propylene glycol, dipropylene glycol, mixed ethylene-propylene glycol ethers. The glycol ethers include lower alkyl ($C_{1-8}$ alkyl)ethers including propylene glycolmethyl ether, propylene glycol ethyl ether, propylene glycol phenyl ether, propylene glycol propyl ether, dipropylene glycol methyl ether, dipropylene glycol phenyl ether, dipropylene glycol ethyl ether, tripropylene glycol methyl ether, ethylene glycol methyl ether, ethylene glycol ethyl ether, ethylene glycol butyl ether, diethylene glycol methyl ether diethylene glycol phenyl ether, diethylene glycol butyl ether, ethylene glycol dimethyl ether, ethylene glycol monobutyl ether, ethylene glycol phenyl ether and others. The solvent capacity of the cleaners can be augmented by using monoalkanol amines. The solvent, when present is typically present in an amount of from about 0 wt. % to about 20 wt. %. In a preferred embodiment the solvent in not present in a ready to use solution in an amount of no more than 10 wt. %.

Sequestrant

The thickened materials of the invention can contain an organic or inorganic sequestrant or mixtures of sequestrants. Organic sequestrants such as sodium citrate, the alkali metal salts of nitrilotriacetic acid (NTA), dicarboxymethyl glutamic acid tetrasodium salt (GLDA), EDTA, alkali metal gluconates, polyelectrolytes such as a polyacrylic acid, and the like can be used herein. The most preferred sequestrants are organic sequestrants such as sodium gluconate due to the compatibility of the sequestrant with the formulation base.

The present invention can also incorporate sequestrants to include materials such as, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are the preferred sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Metal Protector

The compositions of the invention can contain a material that can protect metal from corrosion. Such metal protectors include for example sodium gluconate and sodium glucoheptonate. If present, the metal protector is present in the composition in an amount of from about 0.1 wt. % to about 10 wt. %.

Additional Components

In addition to the recited components of the compositions of the invention there may also be present adjuvant materials for hard surface cleaning. Such adjuvant materials may include foam enhancing agents, foam suppressing agents (when desired), preservatives, antioxidants, pH adjusting agents, perfumes, colorants, or pacifying or pearlescent agents, builder salts, cosolvents and other useful well understood material adjuvants.

Dyes/Odorants

Various dyes, odorants including perfumes, and other aesthetic enhancing agents may also be included in the compositions. Examples of suitable commercially available dyes include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keystone Aniline and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine or jasmal, and vanillin.

Surface Chemistry Modifiers

Various surface chemistry modifiers can be incorporated into the sprayable composition. Examples of suitable commercially available surface chemistry modifiers include Laponite® silicates available from Southern Clay Products, Inc. The surface chemistry modifiers may have high surface free energy and high surface area which leads to interactions with many types of organic compounds. In one example, suitable surface chemistry modifiers have a surface free energy of about 200 joules/meter$^2$ and a surface area of between about 750 and 800 m$^2$/gram. A suitable concentration range for surface chemistry modifiers in the ready-to-use solution is between about 10 ppm and about 100 ppm.

Ready-To-Use Solution

The RTU has a relatively low anti-mist component concentration. In one suitable formulation the concentration of PEO is between about 0.002% and about 0.006% by weight. In another example, the concentration of PEO is between about 0.003% and 0.005%.

In another suitable RTU the anionic copolymer comprised of acrylamide and AMPS (acrylamide-sodium 2-acrylamido-2-methylpropane sulfonate) concentration is between about 0.002% and 0.01% by weight. In a particularly suitable RTU, the anionic copolymer comprised of acrylamide and AMPS (acrylamide-sodium 2-acrylamido-2-methylpropane sulfonate) concentration is between about 0.003% and about 0.007% by weight.

In a further suitable RTU, the concentration of PEO, anionic copolymer comprised of acrylamide and AMPS (acrylamide-sodium 2-acrylamido-2-methylpropane sulfonate) or a combination thereof is between about 0.002% and about 0.006% by weight. In another example, the concentration of PEO, anionic copolymer comprised of acrylamide and AMPS (acrylamide-sodium 2-acrylamido-2-methylpropane sulfonate) or a combination thereof is between about 0.003% and 0.005%.

Methods of Use

The alkaline compositions of the invention are commonly applied to soiled surfaces using a pressurized aerosol or aerosol pump spray. In pressurized aerosol application, the compositions of the invention are combined with an aerosol propellant and packaged in a metal high pressure container. Typical propellants include lower alkanes such as propane, butane, nitrous oxide, carbon dioxide, and a variety of fluorocarbons. Pressurized aerosol containers typically include a spray head, valve and dip tube that reaches to the opposite end of the container to ensure that the entire contents of the container is dispensed through the action of the propellant. When the valve is opened (depressed), the propellant pressure forces liquid into the dip tube and through the aerosol spray head. At the spray head exit, a spray pattern is created by the geometry of the aerosol valve which directs the material onto the soiled surface. Aerosol containers, dip tubes, propellants and spray valves are a well understood commercial technology. Pump spray devices commonly comprise a container spray head valve pump and dip tube. Actuating the pump causes a piston to travel in a cylinder filled with compositions of the invention. The piston motion forces the composition through an aerosol valve causing the spray to adhere to a soiled surface. Once the piston reaches its full travel path, the piston is returned by a spring action to its original position causing the cylinder to fill with additional quantities of the spray material through a valve opening. As the piston is again pressed through the cylinder the valve closes preventing the exit of any of the solution from the cylinder. The pump spray can deliver substantial quantities of the material onto the soiled surface.

For compositions of the invention that include a thickener, they can be made by combining the ingredients in an aqueous diluent using commonly available containers and blending apparatus. A preferred method for performing the composition of the invention includes introducing into a stirred production vessel, a quantity of the deionized water followed by the organic thickener material used to provide thixotropic properties to the compositions of the invention. After the thickener is fully solubilized, the other ingredients of the invention can be added in any order.

The RTU sprayable composition is a non-Newtonian fluid. Newtonian fluids have a short relaxation time and have a direct correlation between shear and elongational viscosity (the elongational viscosity of the fluid equals three times the shear viscosity). Shear viscosity is a measure of a fluid's ability to resist the movement of layers relative to each other. Elongational viscosity, which is also known as extensional viscosity, is measure of a fluid's ability to stretch elastically under elongational stress. Non-Newtonian fluids do not have a direct correlation between shear and elongational viscosity and are able to store elastic energy when under strain, giving exponentially more elongational than shear viscosity and producing an effect of thickening under strain (i.e., shear thickening). These properties of non-Newtonian fluids result in the sprayable composition that has a low viscosity when not under shear but that thickens when under stress from the trigger sprayer forming larger droplets.

The RTU sprayable composition has a relatively low shear viscosity when not under strain. The shear viscosity can be measured with a Brookfield LVDV-II viscometer using spindle R1, at 50 rpm and room temperature. As described further below, in one example, the shear viscosity of the RTU sprayable composition is comparable to the shear viscosity of water. A suitable shear viscosity for the RTU sprayable composition is about 40 centipoises or less. A more preferable shear viscosity is about 30 centipoises or less. In one example, the anti-mist components do not increase the shear viscosity of the RTU sprayable composition when not under strain and the increased shear viscosity is created by other components, such as the surfactant.

In another example, a flowable RTU sprayable composition contains a sufficient amount of anti-mist component such that the median particle size of the dispensed use solution is sufficiently large enough to reduce misting. A suitable median particle size is about 11 microns or greater. A particularly suitable median particle size is about 50 microns or greater. A more particularly suitable median particle size is about 70 microns or greater, about 100 microns or greater, about 150 microns or greater, or about 200 microns or greater. The suitable median particle size may depend on the composition of the RTU. For example, a suitable median particle size for a strongly alkaline use solution may be about 100 microns or greater, and more particularly about 150 microns or greater, and more particularly about 200 microns or greater. A suitable median particle size for a moderately alkaline RTU may be about 11 microns or greater, preferably about 50 microns or greater, and more preferably about 150 microns or greater. A strongly alkaline RTU may have a pH of about 11 or greater, and a moderately alkaline RTU may have a pH between about 7 and about 11.

In one example, the RTU sprayable compositions are non-Newtonian compositions that generally include at least one source of alkalinity, at least one surfactant, and at least one anti-mist component, such as polyethylene oxide (PEO), anionic copolymer comprised of acrylamide and AMPS (acrylamide-sodium 2-acrylamido-2-methylpropane sulfonate). A suitable concentration range of the components of the RTU sprayable composition includes between approximately 0.1% and 30% by weight surfactant, between approximately 0.1% and 75% by weight of at least one source of alkalinity, and between approximately 0.01% and 5% PEO, anionic copolymer comprised of acrylamide and AMPS (acrylamide-sodium 2-acrylamido-2-methylpropane sulfonate) and water. In a ready to use solution, the water component can comprises from about 25 wt. % to about 95 wt. %.

The RTU solution can be dispensed using an aerosol sprayer or transient stock trigger sprayer (i.e., non-low velocity trigger), which results in limited drifting, misting, and/or atomization of the aqueous use solution. Example transient stock trigger sprayers include but are not limited to Calmar Mixor HP 1.66 output trigger sprayer. Reduction in drift, misting, and atomization can be determined from the droplet size of the applied solution, with an increased droplet size indicating reduced misting and atomization. The increased droplet size also reduces inhalation of the use solution. Preferably, the median droplet size is about 10 microns or greater, about 50 microns or greater, about 70 microns or greater, about 100 microns or greater, about 150 microns or greater and preferably about 200 microns or greater. There are several methods for determining droplet size including, but not limited to, adaptive high speed cameras, laser diffraction, and phase Doppler particle analysis. Commercially available laser diffraction apparatuses include Spraytec available from Malvern and Helos available from Sympatec.

Figure 4:
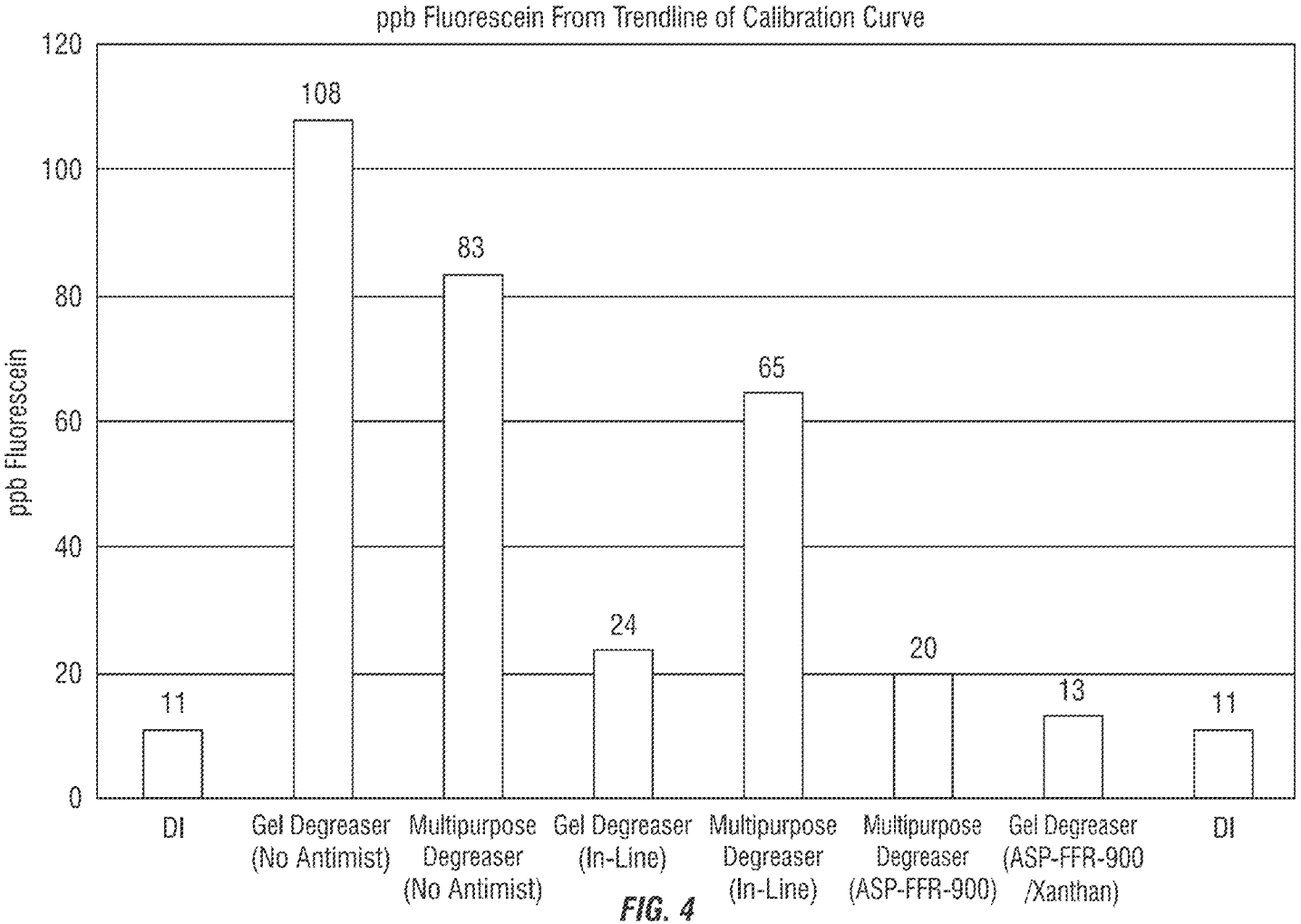
FIG. 4 is another graph showing fluorescence readings converted to PPB with a calibration curve for various solutions with and without the anti-mist components from the calibration curve.

Reduced inhalation can also be measured indirectly by reduced aerosol mass collection from high volume air sampling as shown in FIGS. 4 and 5 and as described in Example 10. Reduced levels of mass correlate directly to reduced inhalation.

When the alkaline cleaning composition containing the anti-mist component is dispersed with a transient trigger sprayer, the resulting droplet size is increased compared to the same sprayable solutions not containing the anti-mist component.

The alkaline cleaning composition may also be dispensed using a low velocity trigger sprayer, such as those available from Calmar. A typical transient trigger sprayer includes a discharge valve at the nozzle end of the discharge end of a discharge passage. A resilient member, such as a spring, keeps the discharge valve seated in a closed position. When the fluid pressure in the discharge valve is greater than the force of the resilient member, the discharge valve opens and disperses the fluid. A typical discharge valve on a stock trigger sprayer is a throttling valve which allows the user to control the actuation rate of the trigger sprayer. The actuation rate of the discharge valve determines the flow velocity, and a greater velocity results in smaller droplets. A low velocity trigger sprayer can contain a two-stage pressure build-up discharge valve assembly which regulates the operator's pumping stroke velocity and produces a well-defined particle size. In one example, the two-stage pressure build-up discharge valve can include a first valve having a high pressure threshold and a second valve having a lower pressure threshold so that the discharge valve snaps open and closed at the beginning and end of the pumping process. Example low-velocity trigger sprayers are commercially available from Calmar and are described in U.S. Pat. No. 5,522,547 to Dobbs and U.S. Pat. No. 7,775,405 to Sweeton, which are incorporated in their entirety herein. The low velocity trigger sprayers may result in less drifting, misting and atomization of the use solution, and may reduce the amount of small droplets dispensed. The sprayable composition containing an anti-mist component may work in synergy with the low velocity trigger sprayer to produce a greater increase in droplet size than expect based on the components alone.

The RTU solution is a non-Newtonian liquid. When not under stress, the RTU solution has a viscosity similar to water. For example, in one embodiment, the RTU solution has a viscosity less than about 40 centipoise.

In some embodiments the solution can be made as a concentrate solution.

Embodiments

The present invention relates to aqueous alkaline sprayable compositions including an anti-mist component, such as polyethylene oxide, anionic copolymer comprised of acrylamide and AMPS (acrylamide-sodium 2-acrylamido-2-methylpropane sulfonate) and cleaning composition comprising the same. The sprayable composition of the current invention is provided in a ready to use form. The RTU is applied to a surface to remove soil using a sprayer device.

Exemplary ranges for the functional components of the sprayable composition are provided below. Additional optional and non-functional components may also be present.

TABLE 1

Ready to use Alkaline Cleaner Composition

| Component | Exemplary First Range (wt. %) | Exemplary second range (wt. %) | Exemplary third range (wt. %) |
|---|---|---|---|
| water | 25-98 | 35-96 | 40-95 |
| Alkalinity source | 0.1-35 | 0.5-30 | 0.8-28 |
| Solvent | 0-40 | 0-35 | 0-30 |
| surfactant | 1-20 | 1.5-15 | 2-10 |
| Anti-mist component | 0.001-0.6 | 0.005-0.5 | 0.01-0.4 |
| Additional Optional Components | 0.001-3 | 0.001-2.5 | 0.001-2 |

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight basis, and all reagents used in the examples were obtained or are available from the chemical suppliers described below or may be synthesized by conventional techniques.

Materials Used

ASP FFR-900 is a commercially available anionic copolymer comprised of acrylamide and AMPS (acrylamide-sodium 2-acrylamido-2-methylpropane sulfonate) which is 20% active available from NALCO, Naperville, Ill.

PolyOx WSR-301™: a non-ionic polyethylene oxide having a molecular weight of 4,000,00 and available from Dow Chemical, Midland, Mich.

"Baked Grease Remover" is a commercially available product from Ecolab.

"Multipurpose Degreaser" is a commercially available cleaner and degreaser from Ecolab.

"Gel Degreaser" is a commercially available clinging gel degreaser available from Ecolab that uses xanthan gum.

Example 1

Title

Elongational Viscosity Measurement

Purpose

Elongational resistance can be measured with the apparatuses such as those described in R. W. Dexter, *Atomization and Sprays, vol.* 6, pp. 167-197, 1996, which is herein incorporated by reference. The apparatus used to measure elongational viscosity in Example 1 comprised five 100-mesh screens packed tightly on top of each other at the base of a 50 mL burette containing a measurable amount of liquid. The mesh screens were contained in an adapter and tubing positioned at the base of the burette. The burette was 74 cm long and had a diameter of 1.5 cm. The adapter and tubing had a length of 10.5 cm, and the mesh screens (i.e., the area available for flow through the adapter and tubing) had a diameter of 1.2 cm. The liquid was forced through the tortuous path formed by the many fine orifices. The time taken for 50 mL of a liquid to flow through the apparatus was measured and correlated to a shear viscosity. The longer the time taken to flow through the packed bed of mesh, the more resistance, and hence, the higher the elongational viscosity. This test was used to evaluate elongational viscosity results at equal actives concentrations for PEO and ASP FFR900.

Procedure:

1) Stock solution of 0.1% by equal actives concentration was prepared for the ASP FFR-900 and PolyOx WSR-301. Dilutions of 0.05% and 0.005% were made from stock.
2) Three trials of each test solution were performed.
3) Before each run DI water was run through the buret and mesh attachment to clean out the system.
4) Control runs of DI water were performed first.
5) DI water (control) was filled to the top of the 50 ml buret then drained until it reached the 0 ml line. Scale tarred to 0.0 g.
6) Stop cock was opened and stop watch started at the same time. Solution allowed to run until scale read 50 g. Stop watch stopped at this point and the time is recorded.
7) Test solutions were run in a similar manor.

Buret Testing of Elongational Viscosity by Equal Actives

| Trial | Sample | Time* (min) | Time(s) |
|---|---|---|---|
| 1 | DI Water | 2:16:75 | 136.75 |
| 2 | DI Water | 2:17:15 | 137.15 |
| 3 | DI Water | 2:16:35 | 136.35 |
| 4 | PEO (0.005%) | 2:54:90 | 174.9 |
| 5 | PEO (0.005%) | 2:50:44 | 170.44 |
| 6 | PEO (0.005%) | 2:51:87 | 171.87 |
| 7 | ASP FFR-900 (0.005%) | 2:39:91 | 159.91 |
| 8 | ASP FFR-900 (0.005%) | 2:35:00 | 155 |
| 9 | ASP FFR-900 (0.005%) | 2:35:50 | 155.5 |
| 10 | PEO (0.05%) | 5:06:07 | 306.07 |
| 11 | PEO (0.05%) | 5:06:85 | 306.85 |
| 12 | PEO (0.05%) | 4:53:53 | 293.53 |
| 13 | ASP FFR-900 (0.05%) | 4:32:75 | 272.75 |
| 14 | ASP FFR-900 (0.05%) | 4:29:82 | 269.82 |
| 15 | ASP FFR-900 (0.05%) | 4:31:63 | 271.63 |
| 16 | PEO (0.1%) | 6:50:88 | 410.88 |
| 17 | PEO 0.1% | 6:48:44 | 408.44 |
| 18 | PEO (0.1%) | 6:42:41 | 402.41 |

-continued

| Trial | Sample | Time* (min) | Time(s) |
|---|---|---|---|
| 19 | ASP FFR-900 (0.1%) | 5:43:99 | 343.99 |
| 20 | ASP FFR-900 (0.1%) | 5:41:29 | 341.29 |
| 21 | ASP FFR-900 (0.1%) | 5:37:94 | 337.94 |

*ASP FFR-900 Concentration of Actives

Shear Viscosity

| | |
|---|---|
| ASP FFR-900 (0.1%) | 39.2 cps |
| PEO (0.1%) | 30 cps |

Sheer Viscosity was measured using Brookfield DV-II+Pro Viscometer, 100 rpm, RV Spindle 2.

Conclusion

The results are shown in FIG. 1. Both compounds at multiple concentrations demonstrate elongational viscosity. PolyOx WSR-301 has higher elongational viscosity than ASP FFR-900 at equal actives concentration.

Example 2

Title

Xanthan Gum Replacement in Baked Grease Remover RTU, Multipurpose Degreaser RTU, Gel Degreaser RTU Formulas with Nalco Polymer ASP FFR-900

Purpose

To determine if the Nalco polymer ASP FFR-900 is an adequate anti-misting substitute for xanthan gum in the three grease removal commercial formulas and in what quantity to match the in-line versions for spray pattern.

Procedure

1. Prepared 400 g samples each of Baked Grease Remover RTU, Multipurpose Degreaser RTU, Gel Degreaser RTU. Control is in line gel degreaser, in line Baked grease remover, and inline multipurpose degreaser.
2. Mixed solutions on a stir plate with stir bar at 200 rpm for ~2 hours at room temperature. Polymer needs time to go into solution.

Observations

Spray testing with a Calmar standard sprayer was done on the Gel Degreaser RTU formula to determine the concentration of ASP FFR-900 needed to match the spray pattern of the in-line version with xanthan gum.

Solutions were sprayed to observe spray pattern visually. Very little misting occurs in both test solution and control however, the control has more vertical cling to the surface where the test solution runs down very quickly.

Final polymer adjustments to match in-line products:

| Product | % wt. ASP FFR-900 |
|---|---|
| Multipurpose Degreaser RTU | 0.04 |
| Gel Degreaser RTU | 0.07 |
| Baked Grease Remover RTU | 0.05 |

Multipurpose Degreaser RTU—Spray pattern was medium width with large droplets. Spray did not cling to the surface as readily as the in-line version with xanthan gum but the xanthan gum version was mistier than the experimental solution with ASP FFR-900.

Gel Degreaser RTU—Spray is mostly stream line with very little misting. Clinging is moderate but not as much in-line.

Baked Grease Remover RTU—Foam sprayer is used for this product. In-line product still appeared to have some misting coming out of the spray at an angle on both sides of the spray nozzle. ASP FFR-900 formula reduced this sideways spraying but the foam was not as rich.

Conclusion

Appropriate ASP FFR-900 levels were tested to match the in-line products for spray pattern and anti-mist qualities. The clinging quality of the polymer is not as strong as the xanthan gum in the in-line products that contain it.

Example 3

Title

ASP FFR-900 Stability Test

Procedure

1. Prepared 500 g solutions of Multipurpose Degreaser RTU and Gel Degreaser RTU.
2. Mixed solutions on a stir plate with a stir bar for ~1 hr at 200 rpm for polymer to go into solution.
3. Poured solutions into different plastic sample cups with lids to be placed at 120° F., Room Temperature, 37° F., 0° F. for a duration of 4 weeks.
4. Put samples in appropriate test chambers.

Observations

Week 1 Clear, no precipitate or phase separation.

Week 2 Clear, no precipitate or phase separation.

Week 3 Clear—120° F. samples still show strong anti-misting qualities.

Week 4 Clear; All samples still show strong anti-misting qualities.

Conclusion

All the samples of Gel Degreaser RTU and Multipurpose Degreaser RTU which were placed in plastic bottles appear to be stable through 4 weeks of stability at varying temperatures. The anti-misting qualities afforded by the ASP FFR-900 polymer were maintained throughout this time as seen through qualitative spraying tests with a Calmar standard sprayer.

| Product | Week 0 | Week 1 | Week 2 | Week 3 | Week 4 |
|---|---|---|---|---|---|
| Multipurpose Degreaser | Stable | Stable | Stable | Stable | Stable |
| Gel Degreaser | Stable | Stable | Stable | Stable | Stable |

Example 4

Title

Grease Formula ASP FFR-900 Polymer Stability with KOH

Purpose

To test whether or not the ASP FFR-900 Polymer is more stable under a 120° F. test with KOH instead of NaOH. NaOH was replaced with equal moles of the KOH in the original formula.

Procedure

1. Prepared 500 g of Multipurpose Degreaser RTU and Gel Degreaser RTU. Samples placed into separate plastic bottles with lids.
2. Mixed solutions on a stir plate with a stir bar for ~1 hr at 200 rpm at room temperature for polymer to go into solution.
3. Poured solutions in to different plastic sample cups with lids to be placed at 120° F., Room Temperature, 37° F., 0° F. for a duration of 4 weeks.

Observation

Week 1—All samples appear to be clear; no precipitate or phase separation.

Week 2—All samples appear to be clear; no precipitate or phase separation.

Week 3—Clear; no precipitate or phase separation, retains strong anti-misting qualities.

Week 4—Clear; no precipitate or phase separation, retains strong anti-misting qualities.

| Product | Week 0 | Week 1 | Week 2 | Week 3 | Week 4 |
|---|---|---|---|---|---|
| Multipurpose Degreaser | Stable | Stable | Stable | Stable | Stable |
| Gel Degreaser | Stable | Stable | Stable | Stable | Stable |

Conclusion

All the samples of Gel Degreaser RTU and Multipurpose Degreaser RTU with the KOH substitute appear to be stable through 4 weeks of stability at varying temperatures. The anti-misting qualities afforded by the ASP FFR-900 polymer were maintained throughout this time as seen through qualitative spraying tests with a Calmar standard sprayer.

Example 5

Title

Gel Degreaser RTU Xanthan Replacement for Clinging Performance

Purpose

To find the best combination of xanthan gum and ASP FFR-900 to reduce misting, cut cost associated with the xanthan gum, and retain the clinging and anti-misting qualities of the Gel Degreaser. The xanthan gum is used for the vertical cling and ASP FFR-900 is for anti-misting.

Procedure

1. Prepared 400 g sample of Gel degreaser RTU based off the following table below
2. Allowed to mix at room temperature for an hour for xanthan to go into solution.
3. Added ASP FFR-900 (if applicable for the sample formula) with stirring at 200 rpm at room temperature.

Samples Tested

Gel Degreaser RTU

| | Test # | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Xanthan Gum Polysaccharide (% wt.) | 0.6 | 0.3 | 0.45 | 0.15 | 0.06 | 0.54 | 0.3 | 0.3 | 0.15 | 0.15 | 0.3 | 0.3 | 0.3 |
| ASP FFR-900 (% wt.) | 0 | 0.3 | 0.15 | 0.45 | 0.54 | 0.06 | 0 | 0.15 | 0 | 0.05 | 0.05 | 0.04 | 0.03 |

Sheer Viscosity

| Gel Degreaser RTU | Viscosity (cps) |
|---|---|
| In line Control, Xanthan (0.6%) | 272.0 |
| Xanthan/ASP FFR-900 Combination, (0.3%/0.03%) | 70.4 |
| ASP FFR-900 (0.07%) | 13.6 |

Sheer Viscosity measured using Brookfield DV-II+Pro Viscometer, RV Spindle 2, 100 rpm.

Observation

Combinations of xanthan gum and ASP FFR-900 were visually evaluated against the control which contained 0.6% wt xanthan gum. Variations were prepared based on vertical cling as seen in above table.

Clinging was still evident in the Gel Degreaser RTU formula at half the level of xanthan gum however the spray pattern was very misty. Very little cling evident in Gel Degreaser RTU at a quarter of the level of xanthan gum (0.15%).

Samples containing 0.1% or more of ASP FFR-900 were too thick to spray. Lower concentrations of ASP FFR-900 proved best options.

Half the level of xanthan gum along with 0.03% (by weight) of ASP FFR-900 proved to reduce misting while not eliminating the clinging factor of the formula when sprayed on a vertical surface.

Conclusion

The combination of the reduced xanthan gum levels (0.3%) and the addition of 0.03% ASP FFR-900 proved to be a good combination to reduce misting without sacrificing the clinging factor of the formula.

Example 6

Title

Gel Degreaser RTU ASP FFR-900/Xanthan Gum Combination Stability

Purpose

To test the stability of the combination of ASP FFR-900 and xanthan gum in the Gel Degreaser RTU formula.

Procedure

1. Prepared 400 g sample Gel Degreaser RTU.
2. Allowed to mix for 30 mins at room temperature to ensure absorption of water. Mixed at 500 rpm.
3. When ASP FFR-900 is added, mixed at 200 rpm at room temperature.
4. Poured into sample cups with lids and placed in appropriate test chamber.

| Gel Degreaser RTU | Week 1 | Week 2 | Week 3 | Week 4 |
|---|---|---|---|---|
| 0 F. | Stable | Stable | Stable | Stable |
| 37 F. | Stable | Stable | Stable | Stable |
| Room Temperature | Stable | Stable | Stable | Stable |
| 120° F. | Stable | Stable | Stable | Stable |

Observations

Week 1—Spray at 0F, 37F, and 120F. show no change in pattern or cling when compared to the Room Temperature sample.

Week 2—Spray at 0F, 37F, and 120F shows no change in pattern or cling when compared to the Room Temperature sample.

Week 3—Spray at 0F, 37F, and 120F shows no change in pattern or cling when compared to the Room Temperature sample.

Week 4—Spray at 0F, 37F, and 120F shows no change in pattern or cling when compared to the Room Temperature sample.

Conclusion

The modified formula is able to withstand 4 weeks under all conditions° without formation of precipitate or loss in anti-misting or clinging.

Example 7

Title

Clinging Performance Test of Vertical Removal of Polymerized Oil

Purpose

To test the ability of the modified Gel Degreaser RTU formulas with the reduced xanthan gum to cling to a vertical surface in comparison to the in-line Gel Degreaser RTU and maintain ability to clean.

Procedure

1. Prepared stainless steel 12"×12" panels for testing.
2. Coated with corn oil (1.25 g) with clean polyurethane foam sponge.
3. Preheated oven to ~362° F.
4. Placed in oven for 15 mins while rotating panels every ~5 mins.
5. Pulled out and allowed to cool.
6. Placed on vertical holding rack.
7. In-line Gel Degreaser RTU sprayed on each panel as a control along with one of the additional formulas. Each formula was tested 3 times.
8. Chemistry was allowed to sit on vertical panel surface for varying amounts of time.

Gel Degreaser RTU formulas tested:

In line Gel Degreaser with 0.6% Xanthan Gum,

Gel Degreaser with ASP FFR-900 0.03%/Xanthan 0.3%

Gel Degreaser with 0.3% Xanthan gum, no ASP FFR900

Observation

The table below shows how long the chemistry was allowed to remain on the surface of the panel before being washed off.

| | | Test | | | | | |
|---|---|---|---|---|---|---|---|
| | | #1 | #2 | #3 | #4 | #5 | #6 |
| Amount of time formula was left on surface * Time (Min | In-Line | 3.5 | 2 | 4 | 2 | 2 | 4 |
| | Xanthan/ASP FFR-900 | — | 2 | — | 2 | — | 4 |
| | ½ Xanthan | 3.5 | — | 4 | — | 2 | — |

Test 1

Left on panel for 3.5 mins. ½ Xanthan Gum formula drained faster and had a wider/mistier spray pattern. Cleaning is not very uniform due to the soil on the panel being cooked unevenly.

Test 2

Left on panel for 2 mins. Cleaning performance was similar between the In Line and Xanthan/ASP FFR-900 formula. Spray patterns were similar but the Xanthan/ASP FFR-900 formula drained immediately on contact.

Test 3

Left on panel for 4 mins. Very large spray pattern on the panel by the ½ Xanthan formula. Cleaning performance may have been hindered by the thin spreading of the chemistry. This formula showed faster drainage than the in-line formula.

Test 4

Left on panel for 2 mins. Spray pattern between the Xanthan/ASP FFR-900 formula and inline were nearly identical. Xanthan/ASP FFR-900 showed drainage immediately after spraying onto surface. Performance after the cleaning time was the same.

Test 5

Left on panel for 2 mins. ½ Xanthan formula had a wide/misty spray pattern similar to previous tests. Drainage occurred immediately for this product. Drainage for in-line occurred towards the end of the 2 mins.

Test 6

Left on panel for 4 mins. Drainage by the Xanthan/ASP FFR-900 formula occurred immediately. Spray patterns were similar to previous tests. Cleaning performance at end of test were the same.

Conclusion

Xanthan/ASP FFR-900 formula shows little to no difference in clinging performance while maintaining cleaning ability as the Xanthan only product on a vertical surface when left to sit for a set amount of time.

Example 8

Title

Molecular Weight (MW) Degradation Study of ASP FFR-900 with Multi-Angle Light Scattering (MALS)

Purpose

To test the storage stability of ASP FFR-900.

Procedure for Degradation Study 1. 0.05% ASP FFR-900 solutions in water, and 2.5% active NaOH were prepared.
2. The solutions were stored in a 120° F. oven for about four weeks.
3. The MWs of the ASP FFR-900 solutions were measured periodically to monitor the MW degradation.

Procedure for MW Determination 1. 0.05% ASP FFR-900 solutions stored at 120° F. for a period of time were taken out the oven, cooled to room temperature, and then further diluted to 0.005% (0.05 mg/mL) with mobile phase (0.3M NaCl, 0.1M $Na_2HPO_4$, 25 ppm $NaN_3$).

2. The diluted solution was stirred with a stir bar at 400 rpm for one hour, centrifuged at 3000 rpm for one hour, and then filtered through a 1.2 μm syringe filter. The final solution was used a stock solution for automated batch MALS measurement that collects light scattering signal as a function of angle and concentration with a multi-angle light scattering detector.
3. The angular and concentration dependent light scattering data are fit to the basic light scattering equation, i.e. Zimm plot, to determine the weight average molecular weight ($M_w$) of the sample.

Figure 2:
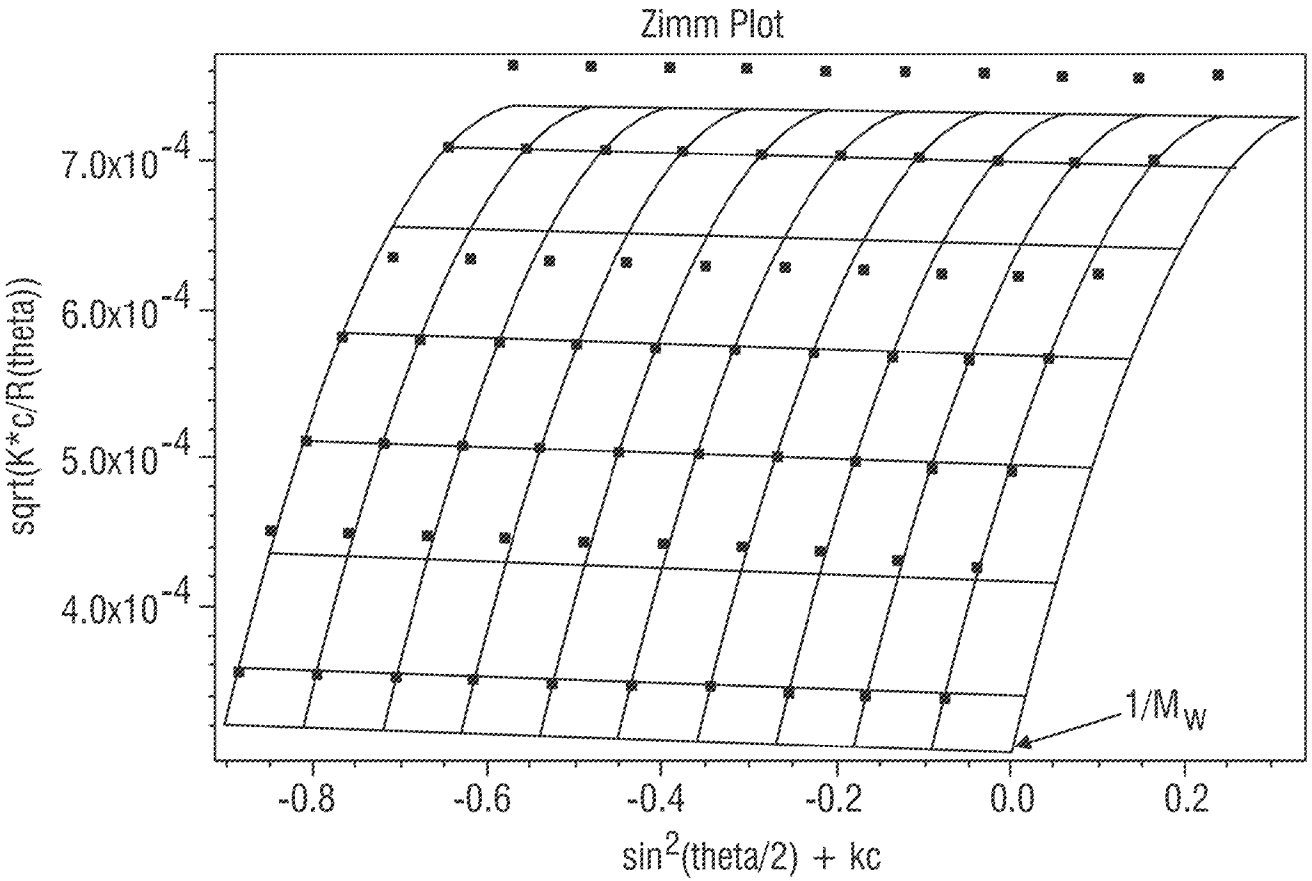
FIG. 2 is a typical Zimm plot of ASP FFR-900 analyzed with batch MALS
Figure 3:
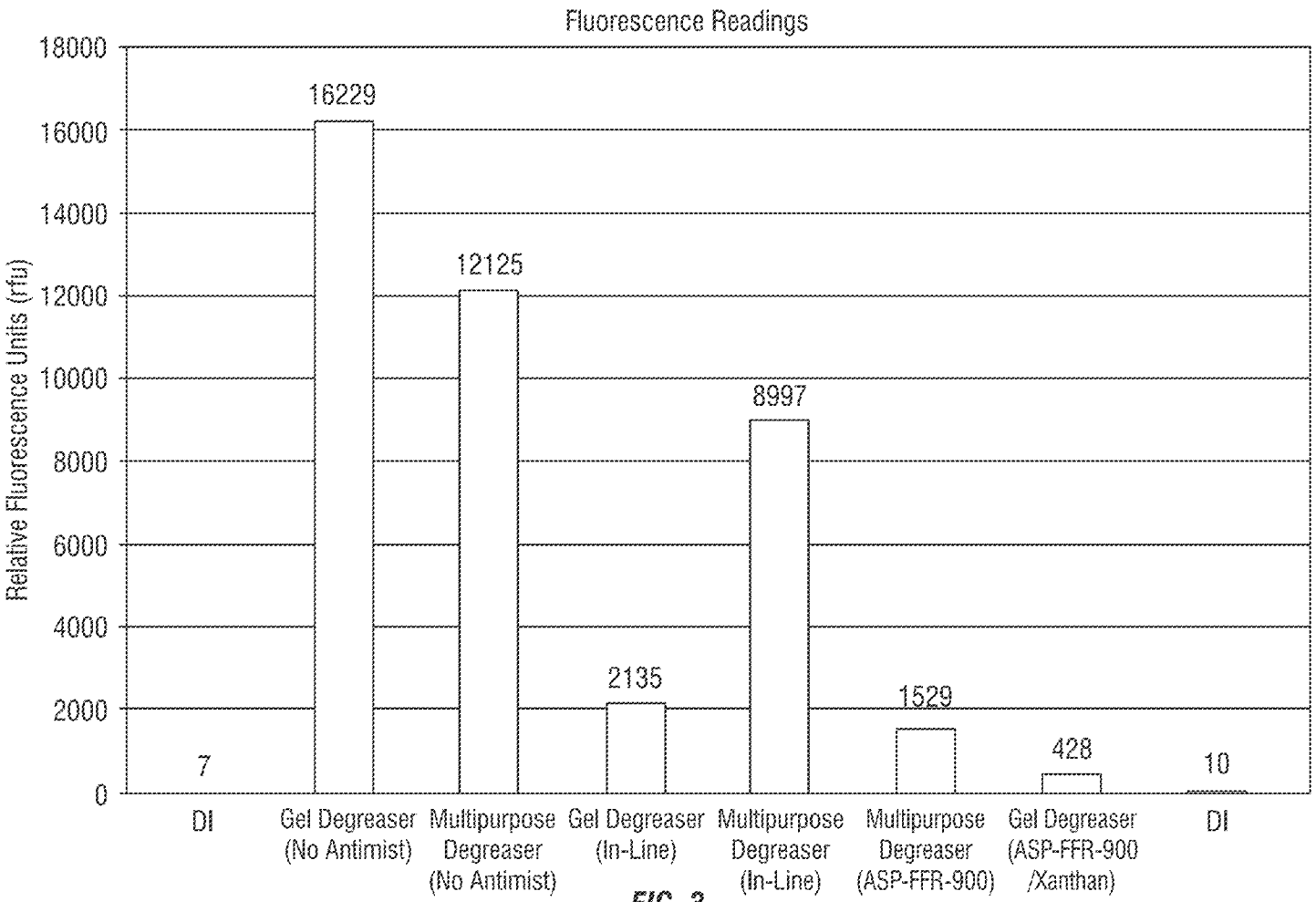
FIG. 3 is a graph showing fluorescence readings for various solutions with and without the anti-mist components.

FIG. 2 is a typical Zimm plot of ASP FFR-900. Weight average molecular weight was calculated from the intercept (indicated by an arrow in FIG. 2) of the extrapolated zero angle and zero concentration lines.

Observations

Two degradation studies were conducted at 120° F. Four-week 120° F. storage roughly equals to one year of shelf life. The MW of ASP FFR-900 samples was monitored with the batch MALS method described above.

The results of two MW degradation studies are shown in the tables below. The results show that the ASP FFR-900 polymer is stable under alkaline conditions during the test. It is surprising that the polymer degrades quickly in pure water. Microbio tests ruled out the possibility of microbial contamination.

120° F. Oven Degradation Study 1

| | $M_w$ ($10^6$ g/mol) | | |
|---|---|---|---|
| Sample | Day 0 | Day 11 | Day 25 |
| ASP FFR-900 in Milli-Q water | 10.0 | 6.1 | 3.4 |

120° F. Oven Degradation Study 2

| | $M_w$ ($10^6$ g/mol) | | |
|---|---|---|---|
| Sample | Day 0 | Day 20 | Day 30 |
| ASP FFR-900 in Milli-Q water | 9.5 | 3.6 | 3.8 |
| ASP FFR-900 in 2.5% active NaOH | 7.6 | 8.0 | 7.4 |

Conclusion

Degradation study was conducted on ASP FFR-900 at 120° F. The MW was monitored during the degradation studies. The result shows that ASP FFR-900 is stable under alkaline conditions after being stored at 120° F. for four weeks that equals to a one-year shelf life.

Example 9

Title

PolyOx WSR-301 Stability Test

Purpose

To take out xanthan gum in Baked Grease Remover RTU, Multipurpose Degreaser RTU, and Gel Degreaser RTU and replace it with PolyOx WSR-301 for anti-mist.

Procedure 1. 500 g samples were prepared of the Baked Grease Remover RTU, Multipurpose Degreaser RTU, and Gel Degreaser RTU with PolyOx WSR-301 added.
2. Sampled were allowed to mix overnight.

Observations

PolyOx WSR-301 is not stable in the Baked Grease Remover RTU and forms a precipitate. With further experimentation it was determined that PolyOx WSR-301 could be added to the Baked Grease Remover RTU and form a stable solution if the level of benzyl alcohol in the formula was reduced by a third.

PolyOx WSR-301 is not stable in the Multipurpose Degreaser RTU and forms clear globs in solution which never fully dissolve. With further experimentation it was determined that PolyOx WSR-301 could be added to the Multipurpose Degreaser RTU and form a stable solution if the level of NaOH in the formula was reduced by half.

PolyOx WSR-301 is not stable in the Gel Degreaser RTU and forms a white fluffy precipitate. With further experimentation it was determined that PolyOx WSR-301 could be added to the Gel Degreaser RTU and form a stable solution if the level of NaOH in the formula was reduced by 60%.

Conclusion

PolyOx WSR-301 can be added as an anti-mist agent and form a stable solution in Baked Grease Remover RTU, Multipurpose Degreaser RTU, and Gel Degreaser RTU if the formulas are modified.

Example 10

High Volume Air Sampler Testing Procedure

Purpose: A measuring method was prepared to evaluate compositions with use of a high volume air sampler and fluorescence to determine the total amount of aerosol particles sprayed Materials Needed

- 4" Diameter Glass Fiber Filters—Whatman GF/A VWR Catalog #28497-222
- High Volume Air Sampler—Staplex Model # TFIA-F
- Tri-pod
- Fluorescent dye tracer at 0.01% in solution of either the chemistry or sprayer to be tested for anti-misting properties
- Fluorescein Disodium Salt CAS #518-47-8—for non-acidic solutions
- Chromatech Red 0551 CAS # Proprietary—for acidic solutions
- Stopwatch
- Fluorescence reader—Bio-Tek Plate Reader
- Bathroom shower surround Procedure for Sample Collection 1. Thoroughly wet shower walls with water.
2. One glass fiber filter is placed in the air intake port of the high volume air sampler. Air sampler sits on a tri-pod which stands 4'6" off the ground and is placed as close to the shower surround as possible.
3. High volume air sampler is turned on and adjusted to an intake rate of 10 $ft^3$/min (0.28 $m^3$/min). At the same time the air sampler is started, 40 sprays of test solution is sprayed into the shower.
4. At the start of the first spray a stopwatch is started and the high volume air sample is allowed to run for a total of 5 minutes.
5. After 5 minutes the high volume air sampler is turned off and the glass fiber filter is removed from the air intake port.

6. The glass fiber filter is place in a container with 30 g of deionized water for extraction of the fluorescent dye tracer off of the filter.

7. The shower walls are thoroughly rinsed and the room aired out before the next test solution is run.

Procedure for Fluorescence Readings

1. A calibration curve from 0 ppb to 500 pbb of the fluorescent dye in deionized water is generated. Excitation wavelength filters, emission wavelength filters, optics configurations, probe height and gain settings on the plate reader are optimized to get the best relative fluorescence unit (rfu) signals as possible.

a. Fluorescein Disodium Salt—Excitation Wavelength=485/20, Emission Wavelength=528/20, Gain=50, Probe Height=12 mm.

b. Chromatech Red 0551-Excitation Wavelength=360/40, Emission Wavelength=590/35, Gain=90, Probe Height=6 mm.

2. Once the fluorescent dye is extracted from the glass fiber filter used in testing, the solution is plated in triplicate onto either a 24 or 96 well solid black plate.

3. Plate is read on the plate reader with given excitation wavelength filter, emission wavelength filter, optics, gain and probe height settings selected.

4. From calibration curve generated, the rfu of the test solutions can be correlated to ppb of dye collected on the filter. From there other calculations can be done.

Conclusion

The formulations of the invention with misting as measured by the above methods are shown in FIGS. 4 and 5. One can see that the relative fluorescence units and PPB Fluorescein is greatly reduced with the formulations including the anti-mist polymers of the invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

Example 11

Title

Gel Degreaser RTU Soil Penetration

Purpose

To compare the speed at which the Gel Degreaser RTU and modified formulas of Gel Degreaser RTU are able to penetrate the polymerized soil on a stainless steel panel via relative soil removal over a set time.

Samples Tested

In line Gel Degreaser control 0.6% Xanthan

Gel Degreaser combination 0.3% Xanthan and 0.03% ASP FFR-900

Gel Degreaser 0.07% ASP FFR-900

Procedure

Panel Preparation

1. Prepared stainless steel 3"×5" panels for testing using the following procedure.
2. Coat with Corn oil (0.13 g) with clean polyurethane foam sponge.
3. Preheated oven to ~362 F.
4. Placed soiled panels in oven for 25 mins while rotating panels once at 10 minutes.
5. Pulled out and allowed cool to room temperature.

Test Procedure

1. Placed panel on flat surface.
2. Used dropper to add ~2 drops of each solution on to panel.
3. Stop watch started.
4. Solutions allowed to remain on surface for 3.5 minutes.
5. Stop watch is stopped and solutions are rinsed off the surface of the panel.

Data Collection

1. The panels were scanned as an 8-bit grayscale image, with each pixel assigned a value between 0 and 255 depending on the darkness of the image.
2. Soiled portions of the panel produce a higher value (173.9 on average) than the bare stainless steel (109.7 on average).
3. A standard area was sampled from each treated spot of the panel and the grayscale values were averaged with three spots per condition.
4. The relative soil removal was calculated on a 0-100 scale by normalizing the values across the range of 109.7 of untreated soil to 173.9 of bare panel. (1−(Clean Panel−Treated Spot)/(Clean Panel−Untreated Soil))*100.

Observations

Samples run in triplicate

Image Analysis Data

Relative Soil removal after 3.5 minutes on a 1-100 scale

| | ASP | Xan-ASP | | Untreated | Clean |
|---|---|---|---|---|---|
| | | | Xanthan | | |
| Average | 171.8 | 159.1 | 145.0 | 109.7 | 173.9 |
| Standard Deviation | 3.8 | 18.8 | 12.5 | 8.3 | 2.0 |
| | | | Inline control Xanthan | | |
| Relative Soil Removal | 97 | 77 | 55 | — | 100 |

Conclusion

The modified Gel DegreaserRTU formulas with less Xanthan gum are able to penetrate and remove the soil more effectively after a set amount of time. It is believed that the increased viscosity from the xanthan gum may inhibit the kinetics of the soil penetration.

What is claimed is:

1. A sprayable alkaline cleaning composition with reduced misting comprising:

(a) a source of alkalinity;

(b) a surfactant;

(c) an effective amount of an anti-mist component comprising an anionic copolymer comprised of acrylamide and AMPS (acrylamide-sodium 2-acrylamido-2-methylpropane sulfonate) with a molecular weight of between about 800,000 and 16,000,000 daltons; and (d) water, wherein the composition is a non-Newtonian composition having a viscosity of less than about 40 centipoise.

2. The alkaline cleaning composition of claim further comprising polyethylene oxide.

3. The alkaline cleaning composition of claim 1, wherein the source of alkalinity is an alkali metal hydroxide.

4. The alkaline cleaning composition of claim 1 wherein water constitutes between about 25% and about 98% by weight of the aqueous composition, the source of alkalinity constitutes between about 0.1% and about 35% by weight of the aqueous composition, the surfactant constitutes between about 0.1% and about 20% by weight of the aqueous composition, and the anti-mist component is acrylamide and AMPS (acrylamide-sodium 2-acrylamido-2-methylpropane sulfonate) constitutes between about 0.001% and about 1.0% by weight of the aqueous composition.

5. The alkaline cleaning composition of claim 1 wherein water constitutes between about 35% and about 95% by weight of the aqueous composition, the source of alkalinity constitutes between about 0.5% and about 30% by weight of the aqueous composition, the surfactant constitutes between about 0.5% and about 15% by weight of the aqueous composition, and the anti-mist component is acrylamide and AMPS (acrylamide-sodium 2-acrylamido-2-methylpropane sulfonate) and constitutes between about 0.005% and about 0.5% by weight of the aqueous composition.

6. The composition of claim 1 wherein the median airborne aerosol particle size is greater than about 200 μm.

7. The composition if claim 6 wherein said airborne aerosol particle size is from a trigger sprayer.

8. The composition of claim 1 wherein said composition is a dilutable concentrate.

9. The composition of claim 1 wherein said composition is a ready to use composition.

10. The composition of claim 1 further comprises a metal protector.

11. A sprayable aqueous grease removing composition formulated to reduce the formation of a choking aerosol when sprayed, the composition comprises:

(a) an effective cleaning amount of a source of alkalinity;

(b) an effective amount of a surfactant of cocamidopropyl betaine, and/or lauryl dimethyl amine oxide;

(c) an effecting thickening amount of an anti-mist component selected from the group consisting of polyethylene oxide, and/or an anionic copolymer comprised of acrylamide and AMPS (acrylamide-sodium 2-acrylamido-2-methylpropane sulfonate) and combinations thereof, and (d) water; wherein the alkaline composition obtains a median airborne aerosol particle size of greater than about 170 μm when sprayed.

12. The composition of claim 11 wherein the source of alkalinity is an alkali metal hydroxide.

13. A sprayable aqueous grease removing composition formulated to reduce the formation of a choking aerosol when sprayed, the composition comprises:

(a) an effective cleaning amount of a source of alkalinity;

(b) an effective amount of a surfactant;

(c) an effecting thickening amount of an anti-mist component selected from the group consisting of polyethylene oxide, and/or an anionic copolymer comprised of acrylamide and AMPS (acrylamide-sodium 2-acrylamido-2-methylpropane sulfonate) and combinations thereof, c) a solvent of benzyl alcohol and (d) water; wherein the alkaline composition obtains a median airborne aerosol particle size of greater than about 170 μm when sprayed.

* * * * *

UNITED STATES PATENT AND TRADEMARK OFFICE

CERTIFICATE OF CORRECTION

PATENT NO. : 9,206,381 B2
APPLICATION NO. : 13/926439
DATED : December 8, 2015
INVENTOR(S) : Charles A. Hodge et al.

It is certified that error appears in the above-identified patent and that said Letters Patent is hereby corrected as shown below:

In The Claims

Column 24, Claim 1, Line 53:

Delete the numeral "800,000" and insert therein --8,000,000--.

Column 24, Claim 2, Line 57:

After the word claim, insert the numeral --1--.

Signed and Sealed this
Eighth Day of March, 2016

Michelle K. Lee

Michelle K. Lee
*Director of the United States Patent and Trademark Office*